US007955185B2

(12) United States Patent
Tavares et al.

(10) Patent No.: US 7,955,185 B2
(45) **Date of Patent: *Jun. 7, 2011**

(54) RELEASABLE AND INTERCHANGEABLE CONNECTIONS FOR GOLF CLUB HEADS AND SHAFTS

(75) Inventors: Gary G. Tavares, Azle, TX (US); John Thomas Stites, Weatherford, TX (US); James Thomas, Fort Worth, TX (US); Raymond J. Sander, Benbrook, TX (US); Vincent J. Contini, Powell, OH (US); James Prescott, Columbus, OH (US); Brian Fortner, New Albany, OH (US)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/718,807

(22) Filed: Mar. 5, 2010

(65) Prior Publication Data

US 2010/0160064 A1 Jun. 24, 2010

Related U.S. Application Data

(63) Continuation of application No. 11/774,513, filed on Jul. 6, 2007, now Pat. No. 7,722,474.

(51) Int. Cl.
*A63B 53/02* (2006.01)

(52) U.S. Cl. ..... 473/288; 473/307; 473/309

(58) Field of Classification Search ..... 473/288, 473/307, 298–299, 309
See application file for complete search history.

(56) References Cited

U.S. PATENT DOCUMENTS

| | | | |
|---|---|---|---|
| 1,266,529 | A | 5/1918 | Mattem |
| 1,792,852 | A | 12/1926 | Matterm |
| 1,623,523 | A | 4/1927 | Bourke |
| 1,634,082 | A | 6/1927 | Rigby |
| 1,850,843 | A | 3/1932 | Lagerblade |
| 2,067,556 | A | 1/1937 | Wettlaufer |
| 2,219,670 | A | 10/1940 | Wettlaufer |

(Continued)

FOREIGN PATENT DOCUMENTS

GB 392493 5/1933

(Continued)

OTHER PUBLICATIONS

International Search Report in corresponding PCT Application, International Application No. PCT/US2008/073703, Mailed Jan. 21, 2009.

(Continued)

*Primary Examiner* — Stephen L. Blau
(74) *Attorney, Agent, or Firm* — Banner & Witcoff, Ltd.

(57) ABSTRACT

Golf club heads are releasably engaged with shafts so that the club heads and shafts can be readily interchanged and/or so that the shaft position with respect to the club head can be readily changed. Assemblies for connecting the club head and shaft may include: (a) a shaft engaging member including a rotation-inhibiting structure; (b) a club head engaging member including a shaft-receiving chamber and a retaining structure for engaging the rotation-inhibiting structure; and (c) a securing system for releasably securing the shaft engaging member with respect to the club head engaging member. The club head and shaft may be changed by releasing the securing system and exchanging the original parts with different parts. Furthermore, the shaft may be bent or otherwise extend at an angle from the shaft engaging member so as to allow adjustment of the shaft position with respect to the club head.

21 Claims, 9 Drawing Sheets

U.S. PATENT DOCUMENTS

| | | | | |
|---|---|---|---|---|
| 2,451,262 | A | 10/1948 | Watkins | |
| 2,464,850 | A | 3/1949 | Crawshaw | |
| 3,206,206 | A | 9/1965 | Santosuosso | |
| 3,516,697 | A | 6/1970 | Hahn | |
| 3,524,646 | A | 8/1970 | Wheeler | |
| 3,656,366 | A | 4/1972 | Somero | |
| 3,848,737 | A | 11/1974 | Kenon | |
| 3,891,212 | A | 6/1975 | Hill | |
| 4,253,666 | A | 3/1981 | Murphy | |
| 4,340,227 | A | 7/1982 | Dopkowski | |
| 4,522,433 | A * | 6/1985 | Valentine et al. | 285/93 |
| 4,664,382 | A | 5/1987 | Palmer et al. | |
| 4,948,132 | A * | 8/1990 | Wharton | 473/246 |
| 4,984,794 | A | 1/1991 | Pernelle et al. | |
| 5,165,688 | A | 11/1992 | Schmidt | |
| 5,232,224 | A | 8/1993 | Zeider | |
| 5,275,399 | A | 1/1994 | Schmidt | |
| 5,275,408 | A | 1/1994 | Desbiolles et al. | |
| 5,429,355 | A | 7/1995 | Schmidt | |
| 5,433,442 | A | 7/1995 | Walker | |
| 5,577,726 | A | 11/1996 | Fenton | |
| 5,588,921 | A | 12/1996 | Parsick | |
| 5,626,528 | A | 5/1997 | Toulon | |
| 5,792,002 | A | 8/1998 | Bothwell | |
| 5,839,973 | A | 11/1998 | Jackson | |
| 5,851,155 | A | 12/1998 | Wood et al. | |
| 5,855,526 | A | 1/1999 | Honma | |
| 5,906,549 | A | 5/1999 | Kubica | |
| 6,095,929 | A | 8/2000 | Clark | |
| 6,149,533 | A | 11/2000 | Finn | |
| 6,203,443 | B1 | 3/2001 | Britton | |
| 6,251,028 | B1 | 6/2001 | Jackson | |
| 6,270,425 | B1 | 8/2001 | Dyer | |
| 6,273,828 | B1 | 8/2001 | Wood et al. | |
| 6,287,215 | B1 | 9/2001 | Fisher | |
| 6,319,146 | B1 | 11/2001 | Mills | |
| 6,332,945 | B1 | 12/2001 | Lenhof | |
| 6,368,230 | B1 | 4/2002 | Helmstetter et al. | |
| 6,447,404 | B1 | 9/2002 | Wilbur | |
| 6,508,288 | B2 | 1/2003 | Lenhof | |
| 6,547,673 | B2 | 4/2003 | Roark | |
| 6,652,388 | B1 | 11/2003 | Lenhof | |
| 6,669,573 | B2 | 12/2003 | Wood et al. | |
| 6,797,106 | B2 | 9/2004 | Lenhof | |
| 6,890,269 | B2 | 5/2005 | Burrows | |
| 7,017,252 | B2 | 3/2006 | Lenhof | |
| 7,083,529 | B2 * | 8/2006 | Cackett et al. | 473/309 |
| 7,115,046 | B1 | 10/2006 | Evans | |
| 7,144,330 | B2 | 12/2006 | Wade | |
| 7,300,359 | B2 | 11/2007 | Hocknell | |
| 7,326,126 | B2 * | 2/2008 | Holt et al. | 473/307 |
| 7,335,113 | B2 | 2/2008 | Hocknell | |
| 7,344,449 | B2 | 3/2008 | Hocknell et al. | |
| 7,413,518 | B2 * | 8/2008 | Cole et al. | 473/288 |
| 2002/0037773 | A1 | 3/2002 | Wood et al. | |
| 2004/0018886 | A1 | 1/2004 | Burrows | |
| 2004/0018887 | A1 * | 1/2004 | Burrows | 473/307 |
| 2006/0105855 | A1 | 5/2006 | Cackett et al. | |
| 2006/0281575 | A1 | 12/2006 | Hocknell et al. | |
| 2007/0078026 | A1 | 4/2007 | Holt et al. | |
| 2007/0265106 | A1 * | 11/2007 | Burrows | 473/307 |
| 2008/0051211 | A1 | 2/2008 | Hocknell | |
| 2008/0058114 | A1 | 3/2008 | Hocknell | |
| 2008/0070717 | A1 | 3/2008 | Hocknell | |
| 2008/0280693 | A1 * | 11/2008 | Chai | 473/288 |

FOREIGN PATENT DOCUMENTS

| | | |
|---|---|---|
| GB | 443439 | 2/1936 |
| GB | 2331464 | 5/1999 |
| JP | 2000024143 | 1/2000 |
| JP | 2006042951 | 2/2006 |
| WO | 9000424 | 1/1990 |
| WO | 2007022671 | 3/2007 |

OTHER PUBLICATIONS

European Search Report from European Patent Application No. 03748963.0, dated Apr. 7, 2008.

International Search Report, mailed Nov. 7, 2008, PCT/US2008/068083, 13 pages.

International Search Report, mailed Nov. 11, 2008, PCT/US2008/068116, 15 pages.

International Search Report, mailed Nov. 7, 2008, PCT/US2008/067348, 14 pages.

Australian Office Action, corresponding to Australian Application No. 2008275470, dated Oct. 14, 2010, 3 pages.

* cited by examiner

RELEASABLE AND INTERCHANGEABLE CONNECTIONS FOR GOLF CLUB HEADS AND SHAFTS

RELATED APPLICATION DATA

This application is a continuation of co-pending U.S. patent application Ser. No. 11/774,513 filed Jul. 6, 2007. This priority application is entirely incorporated herein by reference.

FIELD OF THE INVENTION

This invention relates generally to golf clubs and golf club heads. More particularly, aspects of this invention relate to golf clubs having releasable connections between the golf club head and the shaft and head/shaft position adjusting features to allow easy interchange of shafts and heads and to allow easy modification of the head/shaft positioning properties.

BACKGROUND

Golf is enjoyed by a wide variety of players—players of different genders and dramatically different ages and/or skill levels. Golf is somewhat unique in the sporting world in that such diverse collections of players can play together in golf events, even in direct competition with one another (e.g., using handicapped scoring, different tee boxes, in team formats, etc.), and still enjoy the golf outing or competition. These factors, together with the increased availability of golf programming on television (e.g., golf tournaments, golf news, golf history, and/or other golf programming) and the rise of well known golf superstars, at least in part, have increased golf's popularity in recent years, both in the United States and across the world.

Golfers at all skill levels seek to improve their performance, lower their golf scores, and reach that next performance "level." Manufacturers of all types of golf equipment have responded to these demands, and in recent years, the industry has witnessed dramatic changes and improvements in golf equipment. For example, a wide range of different golf ball models now are available, with balls designed to complement specific swing speeds and/or other player characteristics or preferences, e.g., with some balls designed to fly farther and/or straighter; some designed to provide higher or flatter trajectories; some designed to provide more spin, control, and/or feel (particularly around the greens); some designed for faster or slower swing speeds; etc. A host of swing and/or teaching aids also are available on the market that promises to help lower one's golf scores.

Being the sole instrument that sets a golf ball in motion during play, golf clubs also have been the subject of much technological research and advancement in recent years. For example, the market has seen dramatic changes and improvements in putter designs, golf club head designs, shafts, and grips in recent years. Additionally, other technological advancements have been made in an effort to better match the various elements and/or characteristics of the golf club and characteristics of a golf ball to a particular user's swing features or characteristics (e.g., club fitting technology, ball launch angle measurement technology, ball spin rates, etc.).

Given the recent advances, there is a vast array of golf club component parts available to the golfer. For example, club heads are produced by a wide variety of manufacturers in a variety of different models. Moreover, the individual club head models may include multiple variations, such as variations in the loft angle, lie angle, offset features, weighting characteristics (e.g., draw biased club heads, fade biased club heads, neutrally weighted club heads, etc.). Additionally, the club heads may be combined with a variety of different shafts, e.g., from different manufacturers; having different stiffnesses, flex points, kick points, or other flexion characteristics, etc.; made from different materials; etc.). Between the available variations in shafts and club heads, there are literally hundreds of different club head/shaft combinations available to the golfer.

Club fitters and golf professionals can assist in fitting golfers with a golf club head/shaft combination that suits their swing characteristics and needs. Conventionally, however, golf club heads are permanently mounted to shafts using cements or adhesives. Therefore, to enable a golfer to test a variety of head/shaft combinations, the club fitter or professional must carry a wide selection of permanently mounted golf club head/shaft combinations (which takes up a considerable amount of storage space and inventory costs) or the club fitter or professional must build new clubs for the customer as the fitting process continues (which takes a substantial amount of time and inventory costs). The disadvantages associated with these conventional options serve to limit the choices available to the golfer during a fitting session and/or significantly increase the expense and length of a session.

SUMMARY

The following presents a general summary of aspects of the invention in order to provide a basic understanding of the invention and various features of it. This summary is not intended to limit the scope of the invention in any way, but it simply provides a general overview and context for the more detailed description that follows.

Aspects of this invention relate to systems and methods for connecting golf club heads to shafts in a releasable manner so that the club heads and shafts can be readily interchanged and/or so that the angle and/or position of the shaft with respect to the club head body (and its ball striking face) can be readily changed. Golf club head/shaft connection assemblies in accordance with examples of this invention may include: (a) a shaft engaging member including an opening providing access to a cylindrical interior chamber for receiving a golf club shaft and a rotation-inhibiting structure extending in an axial direction away from the opening and the cylindrical interior chamber; (b) a club head engaging member including an opening providing access to an interior chamber for releasably receiving at least a portion of the shaft engaging member, wherein the interior chamber of the club head engaging member includes a retaining structure for engaging the rotation-inhibiting structure; and (c) a securing system for releasably securing the shaft engaging member with respect to the club head engaging member. The club head and shaft may be interchanged with respect to one another by releasing the securing system and interchanging the originally present parts (e.g., shafts, club heads, etc.) with different parts having different characteristics. Furthermore, the shaft may be angled and/or the chamber for receiving the shaft in the shaft engaging member may be angled with respect to the axial direction of the club head hosel or club head engaging member so as to allow adjustment of the angle or position of the shaft with respect to the club head (e.g., with respect to its ball striking face).

BRIEF DESCRIPTION OF THE DRAWINGS

A more complete understanding of the present invention and certain advantages thereof may be acquired by referring to the following detailed description in consideration with the accompanying drawings, in which.

Figure 1:
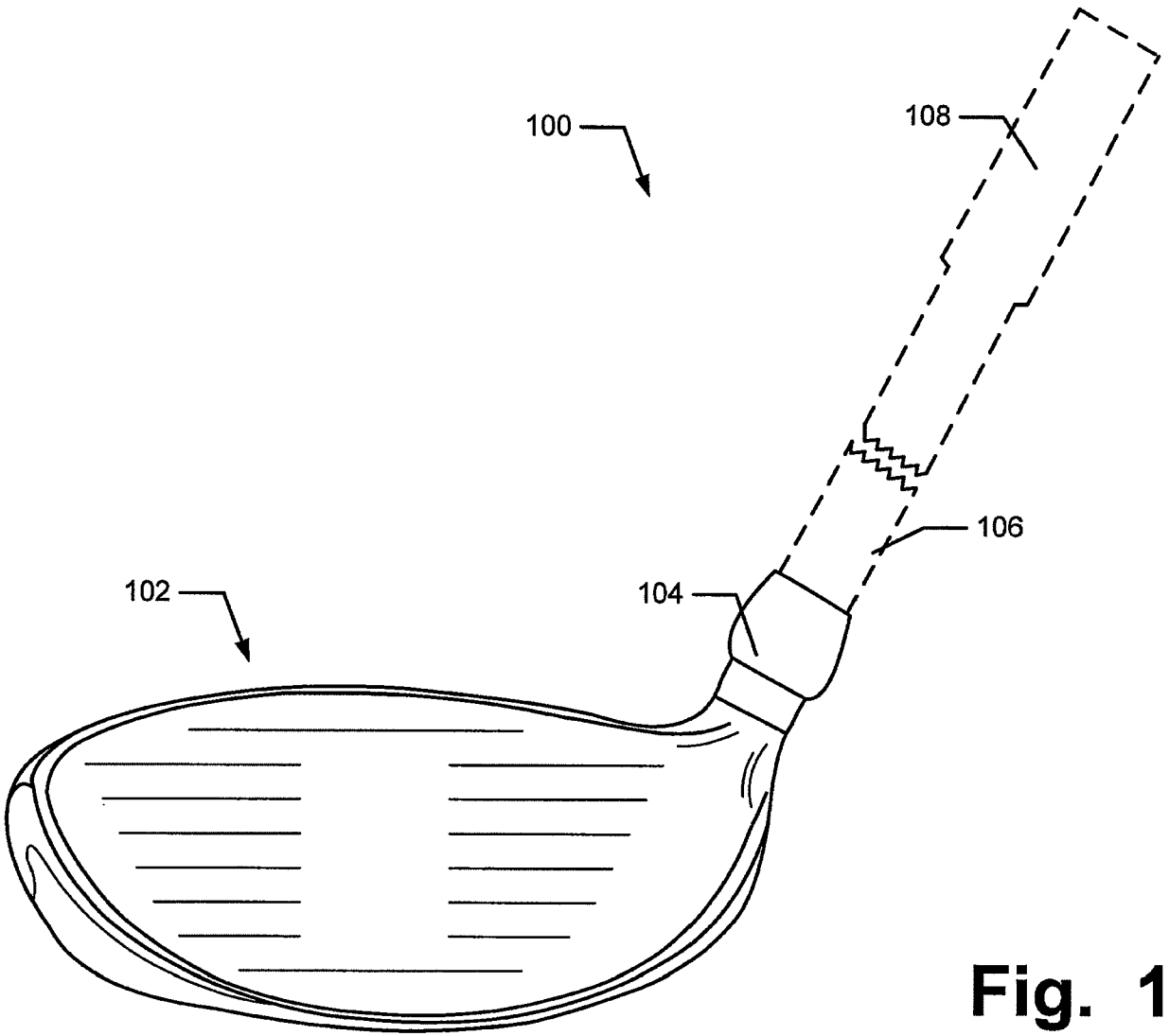
FIG. 1 generally illustrates a front view of an example golf club according to this invention.

The reader is advised that the attached drawings are not necessarily drawn to scale.

DETAILED DESCRIPTION

In the following description of various example structures in accordance with the invention, reference is made to the accompanying drawings, which form a part hereof, and in which are shown by way of illustration various example connection assemblies, golf club heads, and golf club structures in accordance with the invention. Additionally, it is to be understood that other specific arrangements of parts and structures may be utilized, and structural and functional modifications may be made without departing from the scope of the present invention. Also, while the terms "top," "bottom," "front," "back," "rear," "side," "underside," "overhead," and the like may be used in this specification to describe various example features and elements of the invention, these terms are used herein as a matter of convenience, e.g., based on the example orientations shown in the figures and/or the orientations in typical use. Nothing in this specification should be construed as requiring a specific three dimensional or spatial orientation of structures in order to fall within the scope of this invention.

A. General Description of Golf Club Head/Shaft Connection Assemblies and Golf Clubs Including Such Assemblies According to Examples of the Invention In general, as described above, aspects of this invention relate to systems and methods for connecting golf club heads to shafts in a releasable manner so that the club heads and shafts can be readily interchanged and/or repositioned with respect to one another. More detailed descriptions of aspects of this invention follow.

1. Example Golf Club Head/Shaft Connection Assemblies and Golf Club Structures According to the Invention One aspect of this invention relates to golf club head/shaft connection assemblies for securely but releasably connecting a golf club head and shaft. Such assemblies may include, for example: (a) a shaft engaging member including an opening providing access to a cylindrical interior chamber for receiving a golf club shaft and a rotation-inhibiting structure extending in an axial direction away from the opening and the cylindrical interior chamber; (b) a club head engaging member including an opening providing access to an interior chamber for releasably receiving (and holding) at least a portion of the shaft engaging member, wherein the interior chamber of the club head engaging member includes a retaining structure for engaging the rotation-inhibiting structure; and (c) a securing system for releasably securing the shaft engaging member with respect to the club head engaging member. The assemblies further may include a retaining element engaged with at least one of the shaft engaging member and the club head engaging member.

The rotation-inhibiting structure(s) of the shaft engaging member may take on a wide variety of forms in golf club head/shaft connection assemblies in accordance with examples of this invention. In some example structures, the rotation-inhibiting structure will have a polygon cross section (e.g., a polygon having 18 or fewer sides, and in some examples, a polygon having 12 or fewer sides, 10 or fewer sides, eight or fewer sides, six or fewer sides, or even four or fewer sides), and it will fit into a retaining structure (e.g., an opening or chamber in the club head engaging member) having a size and shape adapted to inhibit rotation of the shaft engaging member with respect to the club head engaging member (e.g., having the same general polygon shape). In some more specific example structures according to the invention, the rotation-inhibiting structure of the shaft engaging member will have a square or rectangular cross section and the retaining structure of the club head engaging member will include a square or rectangular shaped opening that receives the rotation-inhibiting structure.

The rotation-inhibiting structure of the shaft engaging member also may take on a variety of different sizes and constructions without departing from this invention. In some example structures, the shaft engaging member will be generally cylindrical with an open circular cylindrical chamber for receiving a golf club shaft. The rotation-inhibiting structure may extend beyond this open chamber in the general axial direction of the overall shaft engaging member structure. In some examples, the rotation-inhibiting structure of the shaft engaging member will extend less than 50% of an overall axial length of the shaft engaging member, and it may extend less than 35%, less than 25%, or even less than 15% of the overall axial length of the shaft engaging member. This feature can help keep the overall connection assembly relatively short, compact, and lightweight.

As a more specific example, golf club head/shaft connection assemblies in accordance with at least some examples of this invention may include: (a) a shaft engaging member having a first end and a second end, wherein the first end includes an opening providing access to a cylindrical interior chamber for receiving a golf club shaft, wherein an exterior surface of the first end includes an extending portion extending in a radial direction away from the cylindrical interior chamber, and wherein an exterior surface of the second end located beyond the cylindrical interior chamber includes a rotation-inhibiting structure; (b) a club head engaging member having a first end and a second end, wherein the first end of the club head engaging member includes an opening for releasably receiving the shaft engaging member, wherein the first end of the club head engaging member further includes a securing structure, and wherein an interior of the second end of the club head engaging member includes a rotation-inhibiting structure for engaging the rotation-inhibiting structure of the shaft engaging member; and (c) a securing member extending over the extending portion of the shaft engaging member and releasably engaging with the securing structure of the club head engaging member, wherein the securing member, at least in part, releasably secures the shaft engaging member with the club head engaging member. Such assemblies also may have one or more of the various more specific features or characteristics described above.

In some example golf club head/shaft connection assemblies in accordance with the invention, the second end of the club head engaging member further may include a portion extending beyond the rotation-inhibiting structure of the club head engaging member and the second end of the shaft engaging member may include a projection extending beyond its rotation-inhibiting structure (the projection may extend into the portion of the club head engaging member extending beyond its rotation-inhibiting structure). An additional retaining element may be provided, extending into the portion of the club head engaging member extending beyond its rotation-inhibiting structure, and this retaining element may engage the projection and/or the portion of the club head engaging member extending beyond its rotation-inhibiting structure. Alternatively, if desired, the retaining element may be integrally formed as a unitary structure with the club head engaging member.

Aspects of this invention further relate to golf club structures that include club head/shaft connection assemblies according to the invention. Such structures may include a golf club shaft engaged with the shaft engaging member and a club head body engaged with the club head engaging member. The shaft and club head engaging members then are engaged together (e.g., by sliding the shaft engaging member into the interior chamber defined by the club head engaging member and engaging their rotation-inhibiting structures together), and the overall assembly may be releasably secured together (e.g., by engaging a securing member with the club head engaging member and/or the shaft engaging member, or by another releasable mechanical fastener connection), as will be described in more detail below.

2. Example Methods of Assembling Golf Clubs Including Golf Club Head/Shaft Connection Assemblies According to the Invention Another aspect of this invention relates to methods of assembling golf clubs using club head/shaft connection assemblies in accordance with examples of this invention. Such methods may include: (a) engaging a shaft with a shaft engaging member, wherein the shaft engaging member includes an opening providing access to a cylindrical interior chamber and a rotation-inhibiting structure extending in an axial direction away from the opening and the cylindrical interior chamber, and wherein a first end of the shaft extends into the cylindrical interior chamber; (b) engaging a golf club head with a club head engaging member, wherein the club head engaging member includes an opening providing access to an interior chamber; (c) engaging the shaft engaging member with the club head engaging member by placing the shaft engaging member at least partially into the interior chamber of the club head engaging member and engaging the rotation-inhibiting structure of the shaft engaging member with a retaining structure provided in the interior chamber of the club head engaging member (or other rotation-inhibiting structure); and (d) releasably securing the club head engaging member with respect to the shaft engaging member. The various parts of the connection assembly further may have one or more of the various properties and/or constructions described above.

In such structures, the shaft can be quickly and easily exchanged for a different shaft on the club head body (e.g., a shaft of different length, different flex characteristics, different material, etc.). Such additional club assembly steps may include: (a) releasing the club head engaging member with respect to the shaft engaging member; (b) engaging a second shaft with a second shaft engaging member, wherein the second shaft engaging member includes a second opening providing access to a second cylindrical interior chamber and a second rotation-inhibiting structure extending in an axial direction away from the second opening and the second cylindrical interior chamber, and wherein a first end of the second shaft extends into the second cylindrical interior chamber; (c) engaging the second shaft engaging member with the club head engaging member by placing the second shaft engaging member at least partially into the interior chamber of the club head engaging member and engaging the second rotation-inhibiting structure of the second shaft engaging member with the retaining structure provided in the interior chamber of the club head engaging member (or other rotation-inhibiting structure); and (d) releasably securing the club head engaging member with respect to the second shaft engaging member.

Additionally or alternatively, if desired, in such structures, the club head can be quickly and easily exchanged for a different one on the shaft (e.g., a club head of different loft, lie angle, size, brand, etc.). Such additional club assembly steps may include: (a) releasing the club head engaging member with respect to the shaft engaging member; (b) engaging a second golf club head with a second club head engaging member, wherein the second club head engaging member includes a second opening providing access to a second interior chamber; (c) engaging the shaft engaging member with the second club head engaging member by placing the shaft engaging member at least partially into the second interior chamber of the second club head engaging member and engaging the rotation-inhibiting structure of the shaft engaging member with a second retaining structure provided in the second interior chamber of the second club head engaging member (or other rotation-inhibiting structure); and (d) releasably securing the second club head engaging member with respect to the shaft engaging member.

B. General Description of Position/Angle Adjustable Golf Club Head/Shaft Connection Assemblies and/or Golf Clubs According to Examples of the Invention Additional aspects of this invention relate to systems and methods for connecting golf club heads to shafts in a releasable manner so that the club heads and shafts can be readily interchanged and/or so that the position and/or angle of the club head (e.g., the ball striking face) with respect to the shaft may be adjusted. More detailed descriptions of these aspects of this invention follow.

1. Example Position/Angle Adjustable Golf Club Head/Shaft Connection Assemblies and/or Golf Club Structures According to the Invention Example golf club head/shaft connection assemblies in accordance with this example aspect of the invention may include: (a) a shaft engaging member including an exterior surface and an open first end that define an interior chamber for receiving a golf club shaft, wherein the exterior surface extends in a first axial direction and the interior chamber extends in a second axial direction that differs from the first axial direction; (b) a club head engaging member including an opening providing access to an interior chamber for releasably receiving at least a portion of the shaft engaging member; and (c) a system for preventing rotation of the shaft engaging member with respect to the club head engaging member. With such assemblies, the shaft position and/or angle with respect to the club head (and its ball striking face) may be adjusted by rotating the shaft engaging member with respect to the club head engaging member.

These club head/shaft connection assemblies may have any of the more detailed structures and/or features described above. Moreover, such assemblies may be included as part of golf club structures in the same manner described above.

As another example, golf club structures in accordance with at least some examples of this invention may include shafts having one or more bends or other axial direction changes in them. Such golf club structures may include: (a) a shaft including at least one shaft axial direction change region; (b) a shaft engaging member engaged with the shaft such that the shaft axial direction change region is located external to the shaft engaging member, wherein the shaft engaging member includes a rotation-inhibiting structure; (c) a club head engaging member releasably engaged with the shaft engaging member, wherein the club head engaging member includes a retaining structure engaged with the rotation-inhibiting structure to prevent rotation of the club head engaging member with respect to the shaft engaging member; (d) a golf club head engaged with the club head engaging member; and (e) a securing system for releasably securing the club head engaging member with respect to the shaft engaging member. The club head/shaft connection assemblies may have any of the more detailed structures and/or features described above. Moreover, such assemblies may be included as part of golf club structures, e.g., in the same manners described above.

2. Example Methods of Assembling Golf Clubs Including Golf Club Head/Shaft Connection Assemblies According to this Aspect of the Invention As noted above, golf club head/shaft connection assemblies according to these examples of the invention may be incorporated into an overall club head structure, for example, in the manners generally described above (e.g., engaging a shaft with the shaft engaging member, engaging a club head with the club head engaging member, releasably engaging the engaging members together, and releasably securing the structure together in a non-rotational manner). The position and/or angle of the shaft with respect to the club head (e.g., with respect to the ball striking face) also may be changed. Such methods may include: (a) releasing the shaft engaging member with respect to the club head engaging member; (b) changing a position of the shaft engaging member with respect to the club head engaging member (e.g., by relative rotation) to thereby alter a position of a free end of the shaft with respect to a ball striking face of the club head; and (c) releasably re-securing the shaft engaging member with the club head engaging member to thereby releasably secure the shaft with the golf club head at the changed position. As noted above, the shaft may have one or more bends in it and/or the shaft engaging member may have a non-axial bore for receiving the shaft, to thereby allow for adjustment of the position and/or angle of the shaft with respect to the club head (e.g., its ball striking face).

Specific examples of the invention are described in more detail below. The reader should understand that these specific examples are set forth merely to illustrate examples of the invention, and they should not be construed as limiting the invention.

C. Specific Examples of the Invention

FIG. 1 generally illustrates an example golf club 100 in accordance with at least some examples of this invention. This club 100 includes a club head 102, a releasable club head/shaft connection region 104 that connects the club head to a shaft 106 (which will be described in more detail below), and a grip member 108 engaged with the shaft 106. While a driver/wood-type golf club head 102 is illustrated in FIG. 1, aspects of this invention may be applied to any type of club head, including, for example: fairway wood club heads; iron type golf club heads (of any desired loft, e.g., from a 0-iron or 1-iron to a wedge); wood or iron type hybrid golf club heads; putter heads; and the like. The club heads may be made from conventional materials, in conventional constructions, in conventional manners, as are known and used in the art, optionally modified (if necessary, e.g., in size, shape, etc.) to accommodate the releasable club head/shaft connection parts.

Any desired materials also may be used for the shaft member 106, including conventional materials that are known and used in the art, such as steel, graphite, polymers, composite materials, combinations of these materials, etc. Optionally, if necessary or desired, the shaft may be modified (e.g., in size, shape, etc.) to accommodate the releasable club head/shaft connection parts. The grip member 108 may be engaged with the shaft 106 in any desired manner, including in conventional manners that are known and used in the art (e.g., via cements or adhesives, via mechanical connections, etc.). Any desired materials may be used for the grip member 108, including conventional materials that are known and used in the art, such as rubber, polymeric materials, cork, rubber or polymeric materials with cord or other fabric elements embedded therein, cloth or fabric, tape, etc. Optionally, if desired, the grip member 108 may be releasably connected to the shaft 106 using a releasable connection like releasable connection 104 (examples of which will be described in more detail below).

Figure 2A:
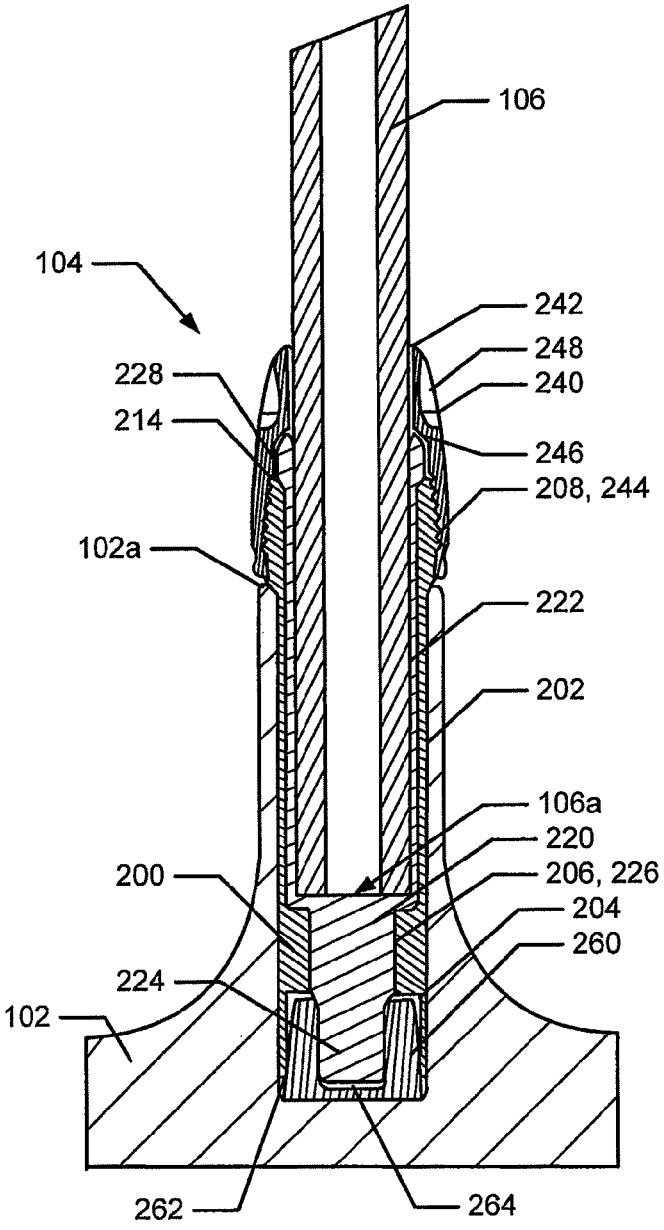
FIGS. 2A and 2B illustrate sectional views of an example golf club head/shaft connection assembly in accordance with this invention in both assembled (FIG. 2A) and exploded (FIG. 2B) conditions.
Figure 2B:
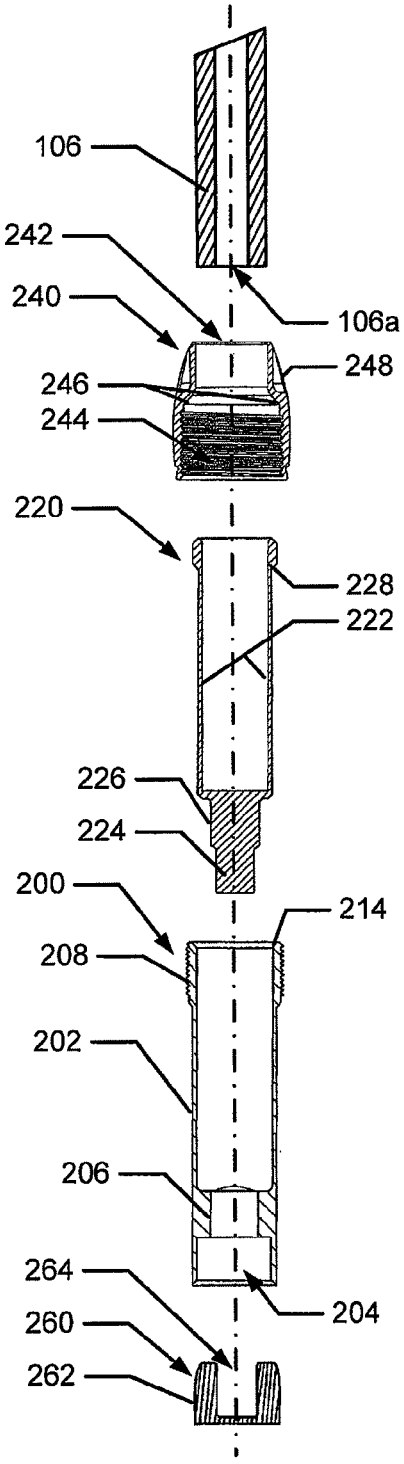

The releasable connection 104 between golf club heads and shafts in accordance with some examples of this invention now will be described in more detail in conjunction with FIGS. 2A through 6. FIG. 2A provides a detailed sectional view of one example releasable connection 104 between a golf club head 102 and a shaft 106 in accordance with this invention, and FIG. 2B illustrates an exploded view of the parts involved in this example connection 104. As shown in these figures, this example connection 104 includes four main parts, namely: a club head engaging member 200, a shaft engaging member 220, a securing member 240, and a retaining member 260. The club head engaging member 200 includes a cylindrical outer surface 202 that fits into the opening 102*a* of the club head 102, e.g., at the club head 102's hosel area, and the club head engaging member 200 may be permanently or releasably secured to the club head 102 in any desired manner, e.g., via cements or adhesives; via welding, brazing, soldering, or other fusing techniques; via mechanical connectors; via a friction fit; etc. Prior to engaging the club head engaging member 200 with the club head 102, if desired, the retaining member 260 may be secured within a lower interior chamber portion 204 of the club head engaging member 200. The retaining member 260 of this example structure 104 includes an outer surface 262 that fits into the lower interior chamber portion 204 of the club head engaging member 200 and may be secured thereto in any desired manner, e.g., via cements or adhesives; via welding, brazing, soldering, or other fusing techniques; via mechanical connectors; via a friction fit; etc.

The shaft engaging member 220 of this example structure 104 includes a cylindrical interior chamber 222 that may be fit over the free end 106*a* of the shaft 106 and may be secured thereto in any desired manner, e.g., via cements or adhesives; via welding, brazing, soldering, or other fusing techniques; via mechanical connectors; via a friction fit; etc. The securing member 240 fits over the free end 106*a* of the shaft 106 and is located along the shaft 106 above the shaft engaging member 220. The securing member 240 opening 242 is sized so as to be rotatable around the exterior of the shaft 106 for reasons to be described in more detail below.

Once the securing member 240 and the shaft engaging member 220 are engaged with the shaft 106 and the club head engaging member 200 (optionally including the retaining element 260) is engaged with the club head 102, the overall connection 104 then may be assembled. This is accomplished in this example connection structure 104 by sliding the shaft engaging member 220 into the interior chamber of the club head engaging member 200. As the shaft engaging member 220 slides through the club head engaging member 200, the projection portion 224 of the shaft engaging member 220 will extend into the bottom interior chamber portion 204 of the club head engaging member 200 and engage the interior chamber 264 of the retaining member 260. At this configuration, the rotation-inhibiting structures 226 of the shaft engaging member 220 will engage corresponding rotation-inhibiting structure 206 of the club head engaging member 200 to thereby prevent the shaft 106 from rotating with respect to the club head 102 (the retaining member 260 in this example structure 104 helps prevent any substantial "play" or movement of the shaft 106 with respect to the club head 102, e.g., due to tolerances in the rotation-inhibiting structures 206 and 226). The securing member 240 then slides down the shaft 106, over the upper end of the shaft engaging member 220, and threadingly engages threaded securing structures 208 provided on the club head engaging member 200. Other releasable mechanical connection systems are possible without departing from this invention. Also, the various steps in this example assembly procedure may be changed, combined, changed in order, etc., without departing from this invention.

To release the connection 104, the threaded (or other) securing member 240 is released from the club head engaging member 200, which allows the shaft engaging member 220 to be slid out of the club head engaging member 200 (the shaft engaging member 220 and the securing member 240 remain on the shaft 106 and the club head engaging member 200 and the retaining member 260 remain in the club head 102). In this manner, a different shaft can be quickly and easily engaged with the same club head 102 and/or a different club head can be quickly and easily engaged with the same shaft 106.

Figure 3A:
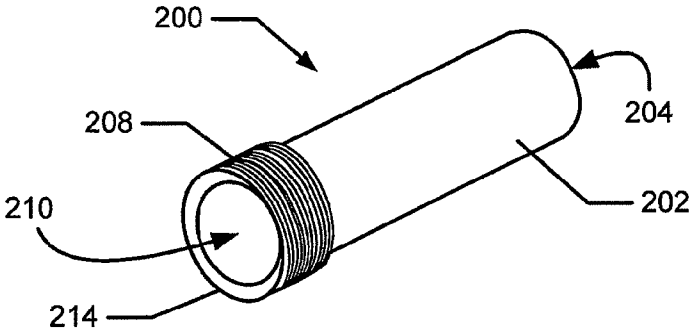
FIGS. 3A through 3C illustrate an example golf club head engaging member that may be used in golf club head/shaft connection assemblies in accordance with this invention.
Figure 3B:
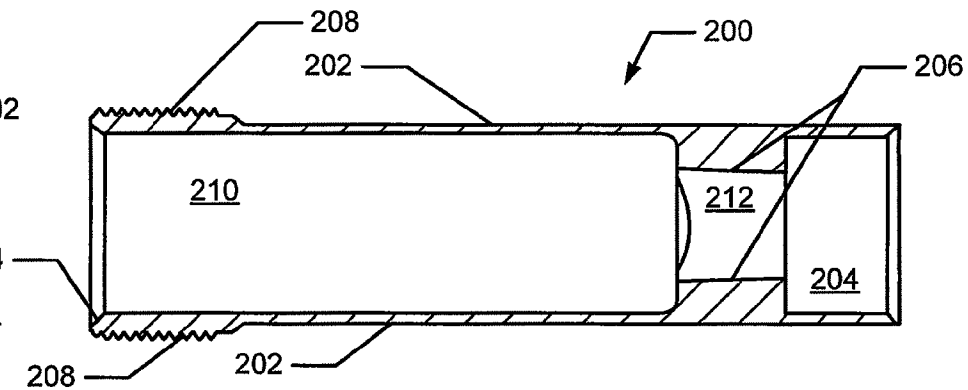
Figure 3C:
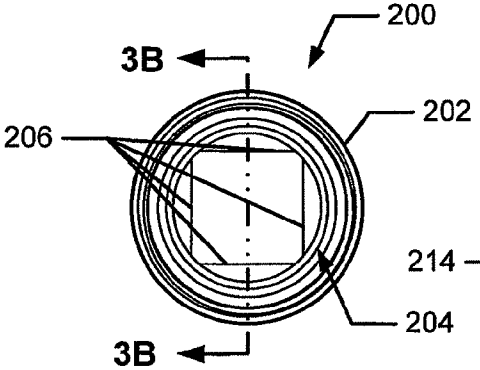

The various individual parts of this example connection structure 104 now will be described in more detail in conjunction with FIGS. 3A through 6. FIGS. 3A through 3C illustrate the club head engaging member 200 in a perspective view (FIG. 3A), a top view (FIG. 3C), and a cross sectional view (FIG. 3B, taken along lines 3B-3B in FIG. 3C). As illustrated, in this example connection structure 104, the club head engaging member 200 is a cylindrical tube (round) structure with an open threaded end 208 and an opposite open end (adjacent interior chamber 204). The interior of the club head engaging member 200 includes a first tubular section 210 for receiving a portion of the shaft engaging member 220, a polygon shaped opening 212 providing rotation-inhibiting structures 206 (or side walls) that engage the rotation-inhibiting structures 226 of the shaft engaging member 220, and the bottom interior chamber 204 for receiving the projection 224 and the retaining member 260. If desired, the rotation-inhibiting structures or side walls 206 may be somewhat sloped (larger or wider toward tubular section 210 as compared to bottom interior chamber 204) to enable easier engagement/disengagement with the rotation-inhibiting structures 226 of the shaft engaging member 220. The outer surface 202 of the club head engaging member 200 may be sized and shaped to fit within and closely engage an opening and/or hosel side walls provided in a golf club head for receiving a shaft (e.g., a hosel opening or other shaft receiving opening provided in a golf club head). The upper free end 214 of the club head engaging member 200 (adjacent the threads 208) is sized and shaped so as to engage shoulder structure 228 on the shaft engaging member 220 and to help stably position the various parts of the connection structure 104 with respect to one another.

Figure 4A:
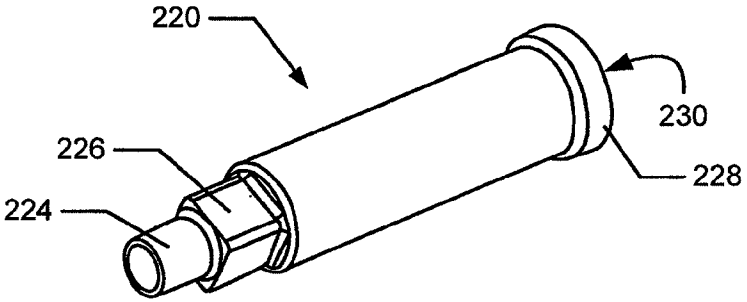
FIGS. 4A through 4D illustrate an example shaft engaging member that may be used in golf club head/shaft connection assemblies in accordance with this invention.
Figure 4B:
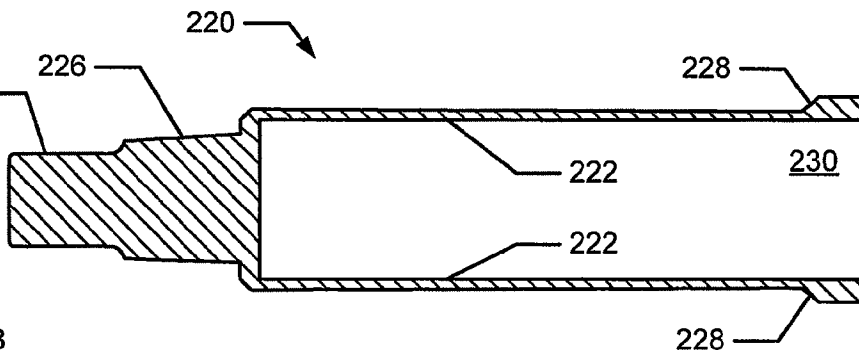
Figure 4C:
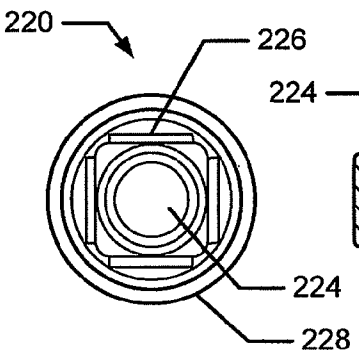
Figure 4D:
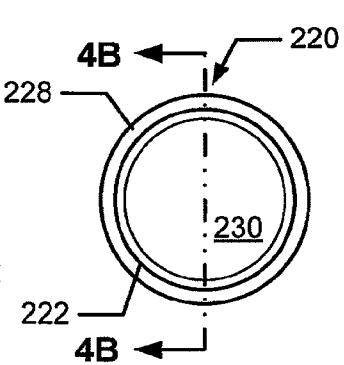

FIGS. 4A through 4D provide a more detailed view of the shaft engaging member 220 of this example connection structure 104. FIG. 4A is a perspective view of this example shaft engaging member 220, FIG. 4D is a top view, FIG. 4C is a bottom view, and FIG. 4B is a cross sectional view taken along line 4B-4B in FIG. 4D. As shown, the shaft engaging member 220 includes an interior chamber 230 for receiving the golf club shaft 106. The rotation-inhibiting member 226 extends away from the chamber 230 in the longitudinal or axial direction of the shaft engaging member 220, and the retaining projection 224 extends in the axial direction beyond the rotation-inhibiting member 226. As described above, the rotation-inhibiting member 226 extends into the correspondingly shaped opening 212 provided in the club head engaging member 200 to thereby help prevent rotation of the shaft engaging member 220 with respect to the club head engaging member 200. Like the side walls 206 of the opening 212, if desired, the rotation-inhibiting member 226 may have somewhat sloped side walls (larger or wider toward chamber 230 as compared to retaining projection 224) to enable easier engagement/disengagement with the rotation-inhibiting structures 206 of the club head engaging member 200.

Figure 5C:
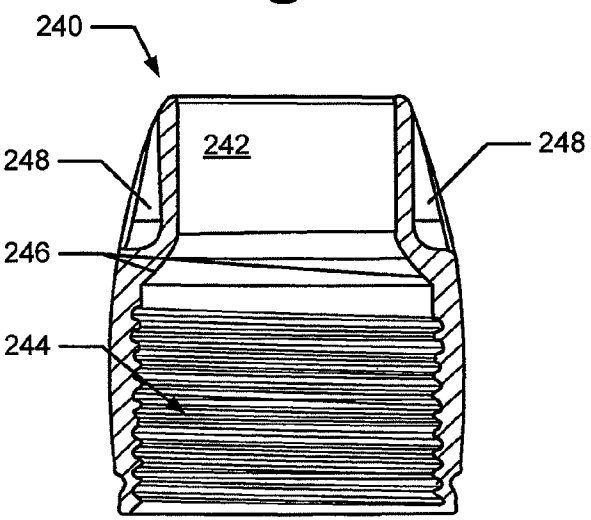
FIGS. 5A through 5C illustrate an example securing member that may be used in golf club head/shaft connection assemblies in accordance with this invention.
Figure 5A:
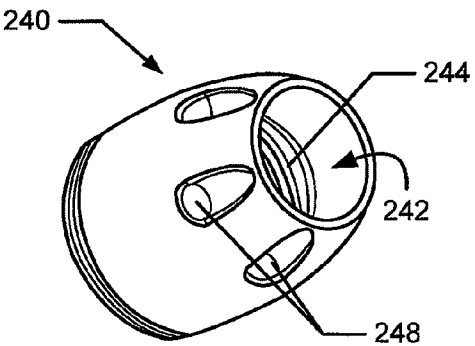
Figure 5B:
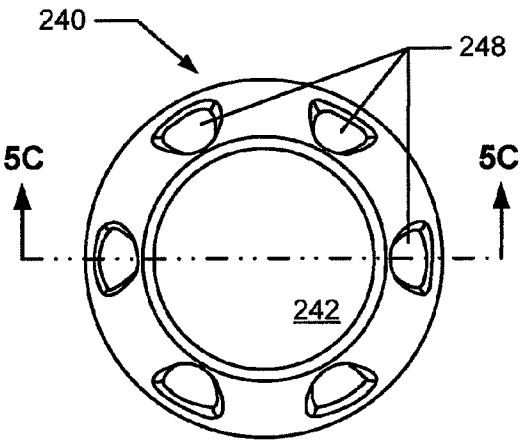

The club head/shaft securing member 240 is illustrated in more detail in FIGS. 5A through 5C (FIG. 5A is a perspective view, FIG. 5B is a top view, and FIG. 5C is a cross sectional view taken along lines 5C-5C in FIG. 5B). The securing member 240 includes an axial opening 242 sized and shaped so as to enable the securing member 240 to freely slide along the free end of the shaft 106. The interior of the securing member 240 includes threads 244 (or other securing structures) for engaging the securing structures 208 provided on the club head engaging member 200. Interior shoulder regions 246 (in this example structure 240 defined by indentations 248) provide structure to engage and hold down the top portion 228 of the shaft engaging member 220 when the securing member 240 engages the club head engaging member 200.

The various parts of the club head/shaft connection system 104 may be made from any desired or suitable materials without departing from this invention. For example, one or more of the various parts 200, 220, and/or 240 may be made from a metal material, including lightweight metals conventionally used in golf club head constructions, such as aluminum, titanium, magnesium, nickel, alloys of these materials, steel, stainless steel, and the like, optionally anodized finished materials. Alternatively, if desired, one or more of the various parts 200, 220, and/or 240 may be made from rigid polymeric materials, such as polymeric materials conventionally known and used in the golf club industry. The various parts 200, 220, and 240 may be made from the same or different materials without departing from this invention. In one specific example, each of the various parts 200, 220, and 240 will be made from a 7075 aluminum alloy material having a hard anodized finish. The parts may be made in conventional manners as are known and used in the metal working and/or polymer production arts.

Figure 6:
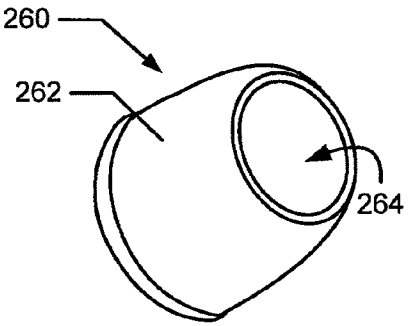
FIG. 6 illustrates an example retaining member that may be used in golf club head/shaft connection assemblies in accordance with this invention.

FIG. 6 illustrates the last part of this example club head/shaft connection structure 104, namely, the retaining member 260. The retaining member 260 in this example structure 104 includes an exterior wall 262 sized to fit into (and frictionally engage) the interior chamber 204 of the club head engaging member 200. The retaining member 260 may be engaged with the club head engaging member 200 in other ways, such as via adhesives or cements, fusing techniques, mechanical connectors, etc. Additionally, the retaining member 260 of this example structure includes an interior chamber 264 that engages the free end of the projection 224 of the shaft engaging member 220. The retaining member 260 further helps hold the shaft engaging member 220 in place with respect to the club head engaging member 200. While it may be made from a wide variety of materials, such as cloth, fabric, rubber, and the like, in this illustrated example structure 104, the retaining member 260 is made from a somewhat flexible polymeric material, e.g., by a molding technique, such as injection molding. In addition to helping hold the shaft engaging member 220 in place with respect to the club head engaging member 200, the material of the retaining member 260 can help attenuate or eliminate noises, e.g., by preventing the metallic parts of the connection 104 from slightly moving with respect to one another or rattling when the club head 102 is moved. If desired, the retaining member 260 may be omitted, relocated, and/or integrally formed as part of the shaft, the club head engaging member, etc.

Many variations in the connection system may be made from the specific structures described above without departing from this invention. For example, if desired, the securing member (e.g., like member 240) may be fit onto the club head structure 102 (e.g., around the hosel), and it may engage external threads (or other securing structures) provided on the shaft engaging member 220. Releasable securing systems other than threaded engagements of a securing member 240 with the club head engaging member 200 and/or the shaft engaging member 220 are possible without departing from this invention. For example, the securing member 240 may include structures that extend into or otherwise engage the club head engaging member 200 and/or the shaft engaging member 220 to thereby hold these members in place with respect to one another. As another example, if desired, the securing member 240 may include slots, openings, or grooves that provide access to structures extending from the club head engaging member 200 and/or the shaft engaging member 220 to thereby hold these members in place with respect to one another. As yet another example, if desired, the separate securing member 240 may be omitted, e.g., if the club head engaging member 200 and/or the shaft engaging member 220 directly include adequate structures to hold themselves in place with respect to one another. The securing member 240 also may be integrally formed or connected with another part of the connection structure 104, the club head 102, and/or the shaft 106.

As another example, the rotation-inhibiting portions 206 and 226 may take on a variety of different structures, such as polygon structures having 20 sides or less, 16 sides or less, 12 sides or less, 10 sides or less, 8 sides or less, or even 6 sides or less. The rotation-inhibiting opening 206 need not exactly match the shape of the rotation-inhibiting structure 226, provided the rotation-inhibiting structure 226 engages some portion of the rotation-inhibiting opening 206 so as to prevent undesired rotation of the shaft engaging member 220 with respect to the club head engaging member 200. Other rotation-inhibiting structures and arrangements also are possible without departing from this invention. For example, either or both of the shaft engaging member 220 and the club head engaging member 200 may include mechanical structures that engage the other part or other parts of the overall golf club so as to prevent rotation. As some more specific examples, the shaft engaging member may include spring loaded pins or other extending structures that extend into openings, slots, or ridges provided in the club head engaging member (and/or vice versa) (e.g., akin to attachment of hydraulic hoses to their hydraulic oil supply connection elements). Detent mechanisms and other physical (and optionally static) securing structures that fit into openings, slots, or ridges also may be used as a releasable rotation-inhibiting connection without departing from this invention.

Figure 7A:
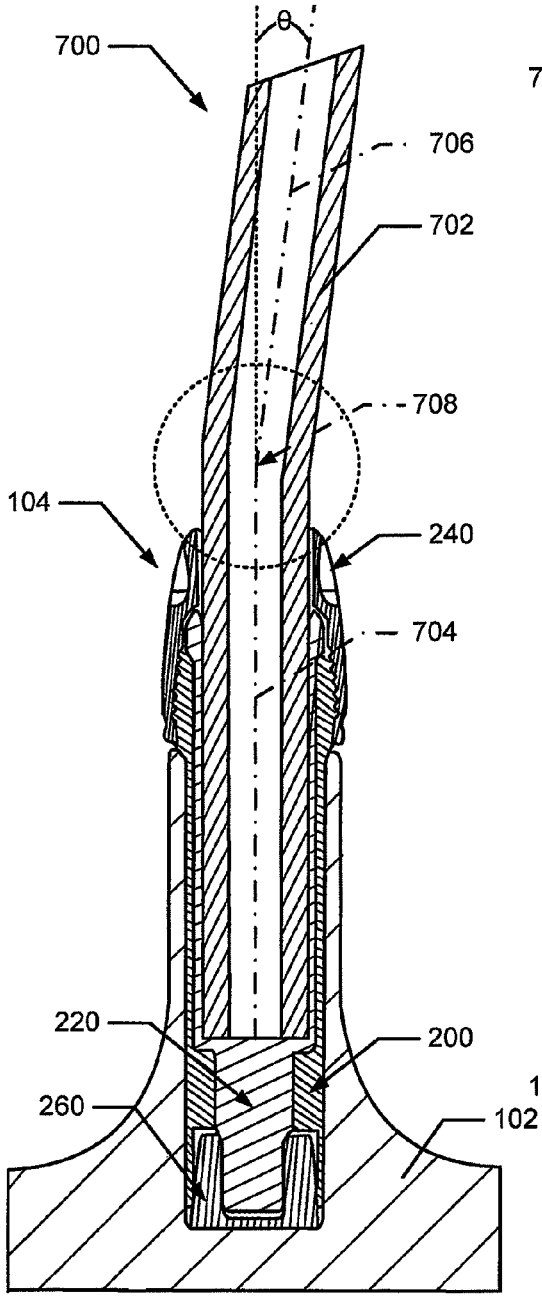
FIGS. 7A and 7B illustrate example aspects of this invention relating to use of an angled shaft member in releasable golf club head/shaft connection assemblies in accordance with this invention.
Figure 7B:
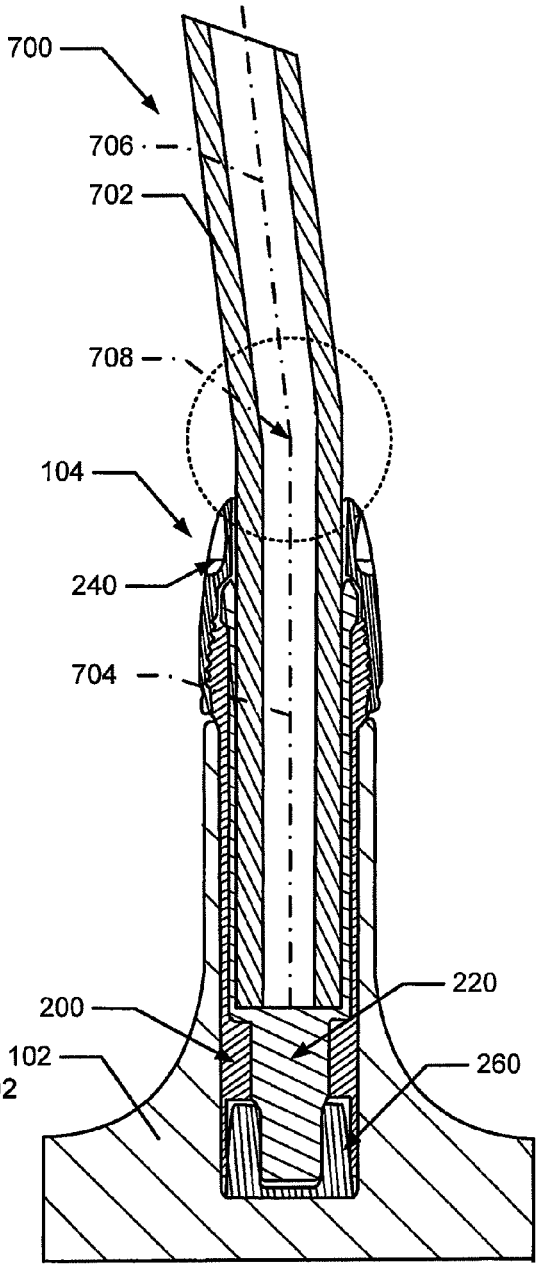

Additional aspects of this invention relate to utilizing releasable golf club head/shaft connection assemblies to enable club fitters (or others) to adjust various positions and/or angles of the club head (and its ball striking face) with respect to the free (grip) end of the shaft (e.g., lie angle, loft angle, etc.). FIGS. 7A and 7B illustrate one example golf club head/shaft connection system 700 in which these angles can be controlled and adjusted. More specifically, FIGS. 7A and 7B illustrate a releasable golf club head/shaft connection assembly 104 similar to that described above in conjunction with FIGS. 2A through 6 (the same or similar reference numbers are used in FIGS. 7A and 7B as those used in FIGS. 1 through 6 to denote the same or similar parts). The shaft 702, however, in this example structure 700, is bent so as to include a first axial direction 704 extending coaxial with the hosel element extending from the golf club head 102 and a second axial direction 706 extending along a major portion of the shaft 702. The axial direction change region 708 (optionally an abrupt bend or a continuous and/or smooth change) transitions the shaft axial direction from the first direction 704 to the second direction 706.

As evident from a comparison of FIGS. 7A and 7B, the angle and/or position of the free end of the shaft 702 (at the location of the grip, remote from the connection assembly 104) may be altered with respect to the club head 102 (and with respect to the ball striking face) by rotating the shaft engaging member 220 with respect to the club head engaging member 200. This feature, along with the releasable connection system 104, allows club fitters (or others) to freely and easily adjust various angles and/or positions of the shaft 702 with respect to the club head 102 (e.g., variable lie, loft, and face angle combinations) while still using the same shaft 702 and head 102, which can help users more easily determine the optimum club head/shaft combination and arrangement to suit their needs.

The axial direction change region 708 may be located at any desired position along the shaft 702 without departing from this invention. In at least some example structures 700 according to this invention, the axial direction change region 708 will be located in the lower half of the shaft 702 nearer to the club head 102 than to the grip end. In some more specific examples, the axial direction change region 708 will be located in the lower quarter of the shaft 702 nearest to the club head 102, and even in the lower 10% or 5% of the shaft 702 nearest to the club head 102. In some example structures 700 according to the invention, the bend or other axial direction change region 708 may be located as close to the securing member 240 or other portion of the connection assembly as possible while still leaving a sufficient distance from the end of the shaft 702 so as to allow free movement of the securing member 240 or other securing mechanism. Alternatively, if desired, the securing member 240 or other securing mechanism may be sized and arranged so as to slip over the axial direction change region 708, and/or it may be releasable from, removable from, and/or attachable to the shaft 702 or other portion of the assembly 104 in another manner.

Also, any desired axial direction change θ (or bend) angle may be used without departing from this invention, e.g., at least 0.25 degrees, at least 0.5 degrees, at least 1 degree, at least 2 degrees, at least 4 degrees, or even at least 8 degrees. In some example structures, this bend or other axial direction change will be between 0.25 and 25 degrees, between 0.5 and 15 degrees, between 1 and 10 degrees, or even between 1 and 5 degrees.

As noted above, FIGS. 7A and 7B illustrate the bent or angled shaft 702 used in conjunction with the connection system 104 described above in connection with FIGS. 2A through 6. This is not a requirement. The various aspects of the invention described above in conjunction with FIGS. 7A and 7B may be used with other releasable golf club head/shaft connection arrangements, such as those described in U.S. Pat. No. 6,890,269 (Bruce D. Burrows) and U.S. Published Patent Appln. No. 2004/0018886 (Bruce D. Burrows), each of which is entirely incorporated herein by reference. Moreover, various aspects of the invention described above in conjunction with FIGS. 7A and 7B may be used in connection with other patented, pending, and/or commercially available releasable golf club shaft assemblies.

Aspects of this invention are not limited to golf club shafts having a single axial direction change region. Rather, as illustrated by the structure 800 shown in FIG. 8A, the shaft 802 may have multiple axial direction change regions (e.g., regions 804 and 806 in FIG. 8A (in FIG. 8A, the same or similar reference numbers are used as those used in FIGS. 1 through 7B to denote the same or similar parts)). This feature allows further fine tuning or control of the position and/or angle of the free end of the shaft 802 (at the grip) with respect to the club head 102 and its ball striking face (e.g., to adjust positions to provide a range of inset, outset, onset, and offset positions and/or optionally to adjust lie, loft, and/or face angle features).

Figure 8A:
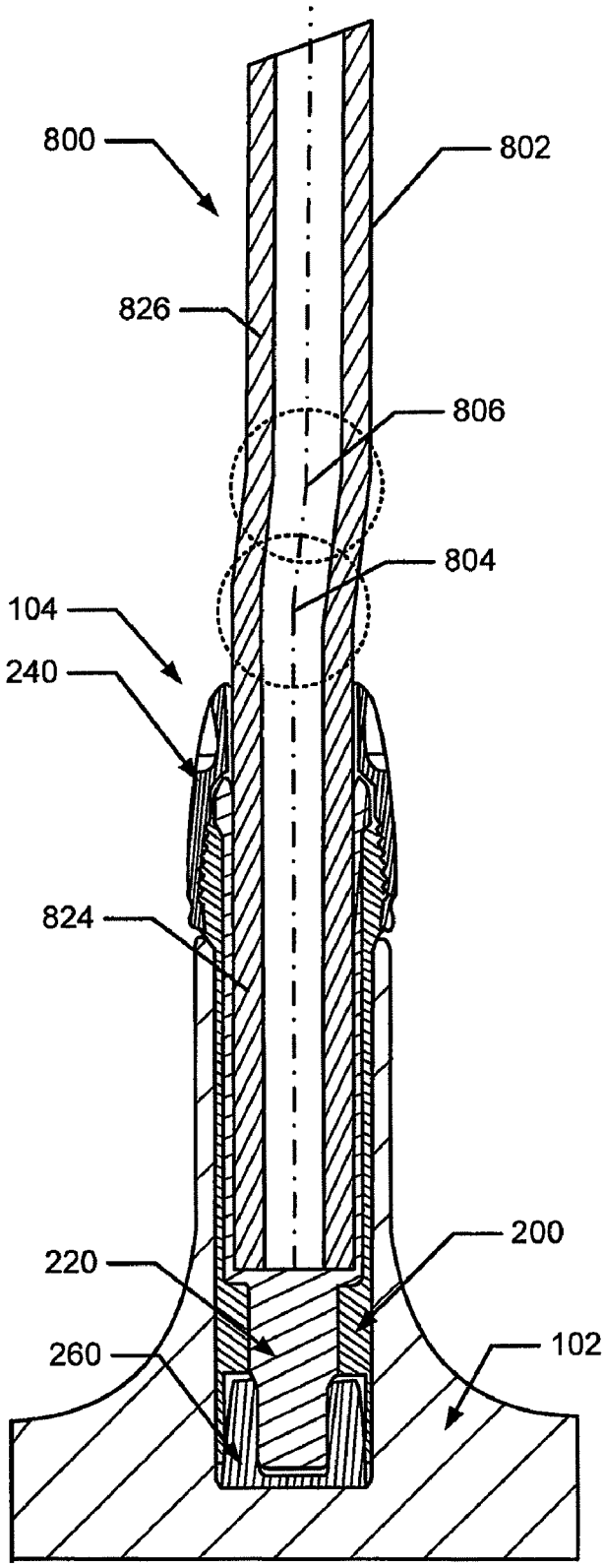
FIGS. 8A and 8B illustrate additional example aspects of this invention relating to use of an angled shaft member in releasable golf club head/shaft connection assemblies in accordance with this invention.
Figure 8B:
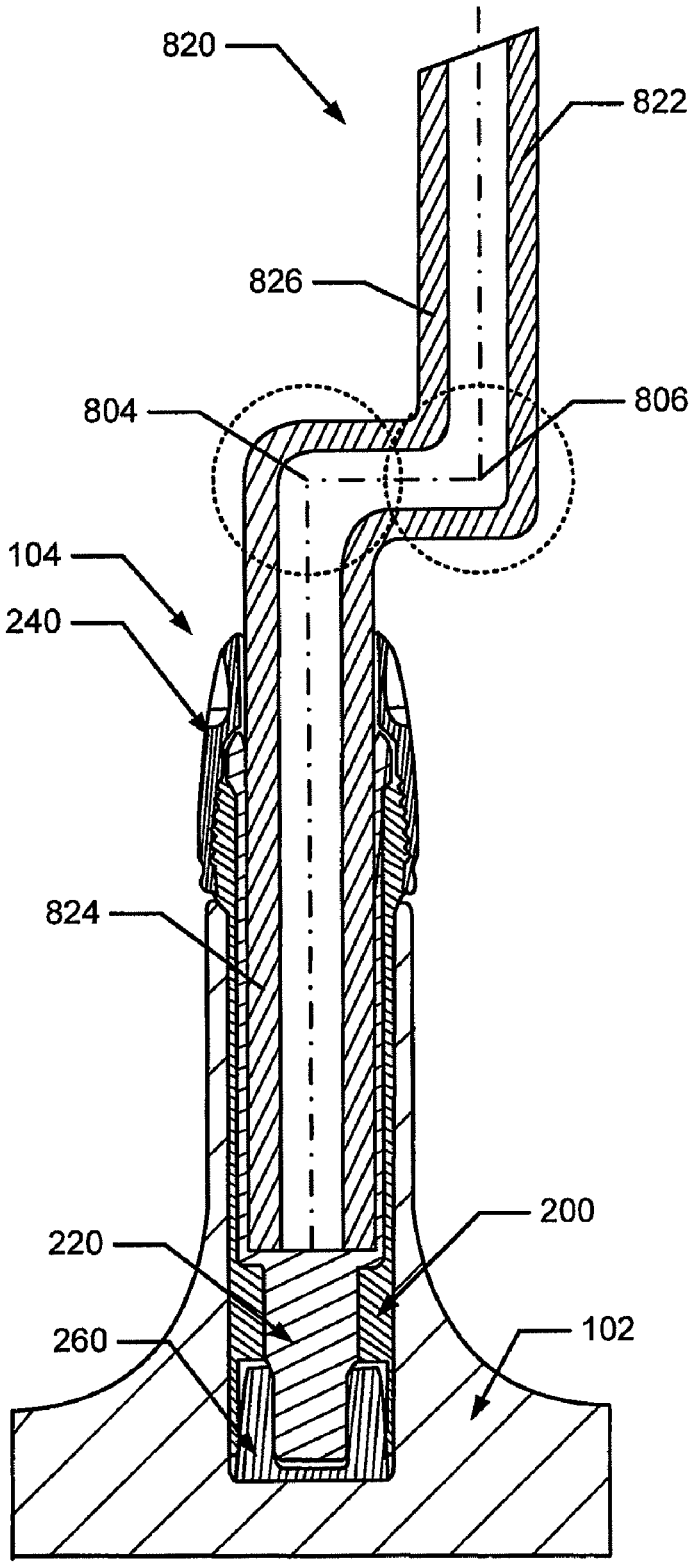

FIG. 8B illustrates another example structure 820 including a releasable golf club head/shaft connection assembly (e.g., like assembly 104) and a shaft 822 having two (or more) axial direction change regions 804 and 806 like those illustrated in FIG. 8A. In this example structure 820, however, the shaft 822 has more abrupt direction change as compared to the structure 800 and shaft 802 of FIG. 8A. This shaft structure 822 also allows control of the position and/or angle of the free end of the shaft 822 (at the grip) with respect to the club head 102 and its ball striking face (e.g., to adjust positions to provide a range of inset, outset, onset, and offset positions and/or optionally to adjust lie, loft, and/or face angle features).

The axial direction change regions 804 and 806 in the various structures (e.g., structures 800 and 820) may be located at any desired positions along the shafts 802 and/or 822 and/or at any desired relative spacing with respect to one another without departing from this invention. In at least some example structures 800 and/or 820 according to this invention, at least one of the axial direction change regions 804 and 806 (and optionally both) will be located in the lower half of the shaft 802 and/or 822 nearer to the club head 102 than to the grip end. In some more specific examples, one or both of the axial direction change regions 804 and 806 will be located in the lower quarter of the shaft 802 and/or 822 nearest to the club head 102, and even in the lower 10% or 5% of the shaft 802 and/or 822 nearest to the club head 102. The axial direction change regions 804 and 806 may be separated from one another by at least ½ inch, at least 1 inch, at least 2 inches, or even at least 4 inches or more without departing from this invention. The bends or other axial direction change regions 804 and 806 may be located a sufficient distance from the end of the shaft 802 and/or 822 and/or from one another so as to allow free movement of the securing member 240 or other securing mechanism, if necessary. Alternatively, if desired, the securing member 240 or other securing mechanism may be sized and arranged so as to slip over one or both of the axial direction change regions 804 and/or 806, and/or it may be releasable from, removable from, and/or attachable to the shaft 802 and/or 822 or other portion of the assembly 104 in another manner.

Also, any desired axial direction change (or bend) angles may be used for each of the two (or more) direction changes without departing from this invention, e.g., at least 0.25 degrees, at least 0.5 degrees, at least 1 degree, at least 2 degrees, at least 4 degrees, or even at least 8 degrees. In some example structures, like those shown in FIG. 8A, these bends or other axial direction changes will be between 0.25 and 25 degrees, between 0.5 and 15 degrees, between 1 and 10 degrees, or even between 1 and 5 degrees. In other example structures, like those shown in FIG. 8B, these bends or other axial direction changes will be between 25 and 145 degrees, between 30 and 120 degrees, between 45 and 100 degrees, or even between 60 and 90 degrees. If desired, one bend may be relatively slight (e.g., as shown in FIG. 8A) while another is more abrupt (e.g., as shown in FIG. 8B). The bends or axial direction changes 802 and 804 may be arranged so that the free ends of the shaft (and the shaft sections 824 and 826 including the free ends) lie on the same plane or on different planes. Also, if desired, more than two bends or axial direction change regions may be provided in a club head shaft structure without departing from this invention.

Like the structure 700 described above in conjunction with FIGS. 7A and 7B, the bent or angled shaft 802 and/or 822 may be used in conjunction with the connection system 104 described above in connection with FIGS. 2A through 6. This is not a requirement. The aspects of the invention described above in conjunction with FIGS. 8A and 8B may be used with other releasable golf club head/shaft connection arrangements, such as those described in U.S. Pat. No. 6,890,269 (Bruce D. Burrows) and U.S. Published Patent Appln. No. 2004/0018886 (Bruce D. Burrows), and those described in other patents, pending patent applications, publications, and/or commercially available releasable golf club shaft assemblies.

Figure 9A:
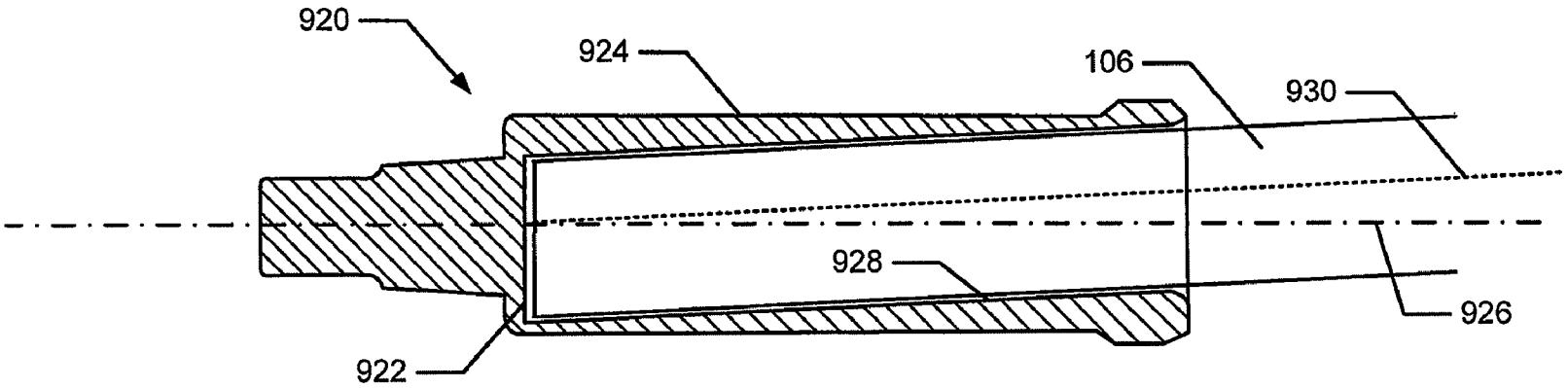
FIGS. 9A and 9B illustrate example aspects of this invention relating to use of an off-axis or angled member for selectively positioning a free end of a shaft with respect to a golf club head face in releasable golf club head/shaft connection assemblies in accordance with this invention.
Figure 9B:
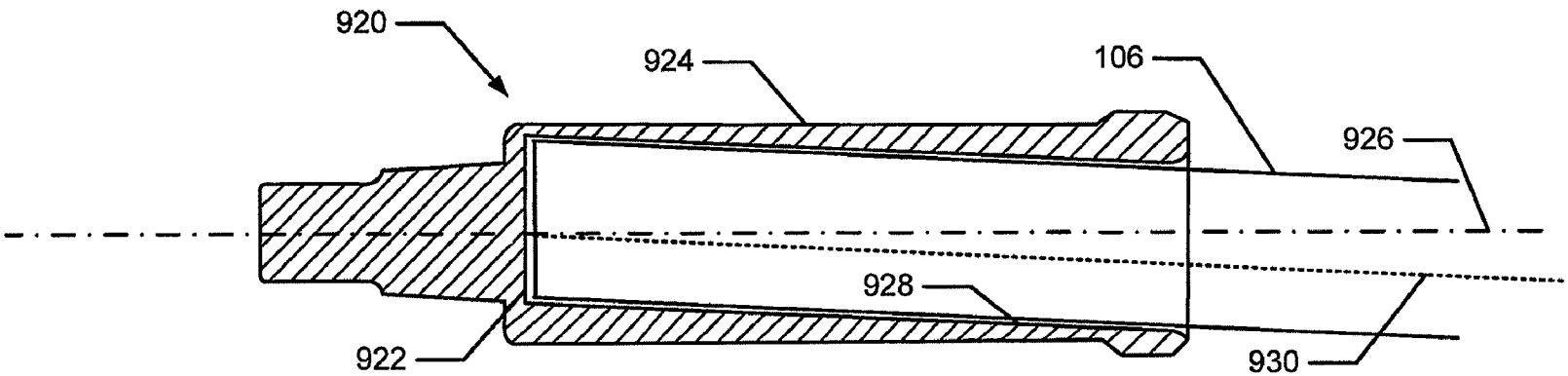

Utilizing a shaft including one or more axial direction change regions is not the only manner in which the position and/or angle of the free (grip) end of a shaft may be altered with respect to a golf club head and/or its ball striking face. FIGS. 9A and 9B illustrate another example arrangement. In this example arrangement, the shaft engaging member 920 includes an "off-axis" or angled bore hole 922 in which the shaft 106 is received. More specifically, in this illustrated example, the outer cylindrical surface 924 of the shaft engaging member 920 (which matches the direction of an interior chamber of a club head engaging member) extends in a first axial direction 926, and the interior cylindrical surface 928 of the bore hole 922 extends in a second axial direction 930 that differs from the first axial direction 926. In this manner, while the shaft engaging member 920 exterior maintains a constant axial direction corresponding to that of the interior of the club head engaging member (e.g., member 200), the shaft 106 extends away from the club head 102 at a different and adjustable angle with respect to the club head 102 and its ball striking face (the shaft position and/or angle may be adjusted, for example, by rotating the shaft engaging member 920 with respect to the club head engaging member 200). This may be seen, for example, by a comparison of the angles of FIGS. 9A and 9B.

While any desired angle may be maintained between the first axial direction 926 and the second axial direction 930, in accordance with some examples of this invention, this angle will be between 0.25 degrees and 10 degrees, and in some examples between 0.5 degrees and 8 degrees, between 0.75 degrees and 6 degrees, or even between 1 degree and 4 degrees.

If desired, the shaft engaging member 920 described above may be used in connection with a shaft connection assembly similar to those described above in conjunction with FIGS. 1-8B. The securing member 240 may have sufficient space or play (and/or the angle of the angled bore 922 may be sufficiently small) so as to enable the securing member 240 to slide over the angle between the shaft 106 and the shaft engaging member 920 exterior surface 924. Alternatively, different securing arrangements may be used to engage the shaft engaging member 920 with the club head and/or the club head engaging member without departing from this invention, including, for example, any of the various securing arrangements and variations thereon described above.

Also, while this specific structure has been described in conjunction with the figures, golf club head/shaft connection structure, and terminology used above in FIGS. 1 through 9B, these aspects of the invention (the angled bore hole) may be extended to other releasable golf club head/shaft connection assemblies that include a member in which the shaft is mounted, such as the assemblies described in U.S. Pat. No. 6,890,269 (Bruce D. Burrows) and U.S. Published Patent Appln. No. 2004/0018886 (Bruce D. Burrows) and/or those used in conjunction with other patented, pending, published, and/or commercially available releasable shaft assemblies. These aspects of the invention also may be used with shafts having one or more axial direction change regions, if desired (such as shafts 802 and/or 822 as illustrated in FIGS. 8A and 8B).

Moreover, the use of an off-axis or angled bore member to alter the club head/shaft angle and/or position characteristics is not limited to use of an off-axis or angled bore in a shaft engaging member. Rather, if desired, the club head engaging member and/or the club head hosel may have an angled bore for receiving the shaft assembly, and the club head/shaft angle and/or position characteristics may be selectively altered by changing the orientation of the club head engaging member and/or the club head hosel with respect to other portions of the overall structure.

Many variations in the overall structure of the shaft, club head, and club head/shaft connection assembly are possible without departing from this invention. For example, if desired, the structure 104 may be somewhat "inverted" such that the securing member 240 is located on the club head (e.g., around the hosel) and it engages the shaft, the shaft engaging member, and/or the club head engaging member to hold the various parts together. Moreover, if desired, the connection system 104 may be used to connect shafts to other elements of a golf club (or other) structure, such as connecting a golf club shaft to a grip element. The various steps of the described assembly processes may be altered, changed in order, combined, and/or omitted without departing from the invention.

Additionally, the releasable connection assemblies may be used in any desired manner without departing from the invention. The clubs with such connection assemblies may be designed for use by the golfer in play (and optionally, if desired, the golfer may freely change shafts, heads, and/or their positioning with respect to one another). As another example, if desired, clubs including releasable connections in accordance with the invention may be used as club fitting tools and when the desired combination of head, shaft, and positioning have been determined for a specific golfer, a club builder may use the determined information to then produce a final desired golf club product using conventional (and permanent) mounting techniques (e.g., cements or adhesives). Other variations in the club/shaft connection assembly parts and processes are possible without departing from this invention.

CONCLUSION

While the invention has been described in detail in terms of specific examples including presently preferred modes of carrying out the invention, those skilled in the art will appreciate that there are numerous variations and permutations of the above described systems and methods. Thus, the spirit and scope of the invention should be construed broadly as set forth in the appended claims.

We claim:

1. A golf club head/shaft connection assembly, comprising:

a shaft engaging member having a first end and a second end, wherein the first end includes a cylindrical interior chamber for receiving a golf club shaft, wherein an exterior surface of the first end includes an extending portion extending away from the cylindrical interior chamber, and wherein the second end includes a rotation-inhibiting structure;

a club head engaging member having a first end and a second end, wherein the first end of the club head engaging member further includes a securing structure, and wherein the second end of the club head engaging member includes a rotation-inhibiting structure for engaging the rotation-inhibiting structure of the shaft engaging member; and a securing member extending over the extending portion of the shaft engaging member and releasably engaging with the securing structure of the club head engaging member, wherein the securing member, at least in part, releasably secures the shaft engaging member with the club head engaging member.

2. A golf club head/shaft connection assembly according to claim 1, wherein the second end of the club head engaging member includes a portion extending beyond the rotation-inhibiting structure of the club head engaging member, wherein the second end of the shaft engaging member includes a projection extending beyond the rotation-inhibiting structure of the shaft engaging member, and wherein the projection extends into the portion of the club head engaging member extending beyond the rotation-inhibiting structure of the club head engaging member.

3. A golf club head/shaft connection assembly according to claim 2, further comprising:

a retaining element extending into the portion of the club head engaging member extending beyond the rotation-inhibiting structure of the club head engaging member.

4. A golf club head/shaft connection assembly according to claim 2, further comprising:

a retaining element engaged with the projection.

5. A golf club head/shaft connection assembly according to claim 1, further comprising:

a retaining element extending into an opening provided at the second end of the club head engaging member.

6. A golf club head/shaft connection assembly according to claim 1, further comprising:

a retaining element engaged with the second end of the club head engaging member.

7. A golf club head/shaft connection assembly according to claim 1, further comprising:

a retaining element engaged with the second end of the shaft engaging member.

8. A golf club head/shaft connection assembly according to claim 1, wherein the rotation-inhibiting structure of the shaft engaging member has a polygon cross section having eight or fewer sides and the rotation-inhibiting structure of the club head engaging member includes a polygon shaped opening that receives the rotation-inhibiting structure of the shaft engaging member.

9. A golf club head/shaft connection assembly according to claim 1, wherein the rotation-inhibiting structure of the shaft engaging member has a square or rectangular cross section and the rotation-inhibiting structure of the club head engaging member includes a square or rectangular shaped opening that receives the rotation-inhibiting structure of the shaft engaging member.

10. A golf club head/shaft connection assembly according to claim 1, wherein the rotation-inhibiting structure of the shaft engaging member extends less than 25% of an overall axial length of the shaft engaging member.

11. A golf club, comprising:

a shaft;

a shaft engaging member engaged with the shaft, the shaft engaging member having a first end and a second end, wherein the first end includes a cylindrical interior chamber for receiving the shaft, wherein an exterior surface of the first end includes an extending portion extending away from the cylindrical interior chamber, and wherein the second end includes a rotation-inhibiting structure;

a club head engaging member releasably engaged with the shaft engaging member, the club head engaging member having a first end and a second end, wherein the first end of the club head engaging member further includes a securing structure, and wherein the second end of the club head engaging member includes a rotation-inhibiting structure releasably engaging the rotation-inhibiting structure of the shaft engaging member;

a golf club head engaged with the club head engaging member; and a securing member extending over the extending portion of the shaft engaging member and releasably engaging the securing structure of the club head engaging member, wherein the securing member, at least in part, releasably secures the shaft engaging member with the club head engaging member.

12. A golf club according to claim 11, wherein the second end of the club head engaging member includes a portion extending beyond the rotation-inhibiting structure of the club head engaging member, wherein the second end of the shaft engaging member includes a projection extending in the axial direction beyond the rotation-inhibiting structure of the shaft engaging member, and wherein the projection extends into the portion of the club head engaging member extending beyond the rotation-inhibiting structure of the club head engaging member.

13. A golf club according to claim 12, further comprising:

a retaining element extending into the portion of the club head engaging member extending beyond the rotation-inhibiting structure of the club head engaging member.

14. A golf club according to claim 12, further comprising:

a retaining element engaged with the projection.

15. A golf club according to claim 11, further comprising:

a retaining element extending into an opening provided at the second end of the club head engaging member.

16. A golf club according to claim 11, further comprising:

a retaining element engaged with the second end of the club head engaging member.

17. A golf club according to claim 11, further comprising:

a retaining element engaged with the second end of the shaft engaging member.

18. A golf club according to claim 11, wherein the rotation-inhibiting structure of the shaft engaging member has a polygon cross section having eight or fewer sides and the rotation-inhibiting structure of the club head engaging member includes a polygon shaped opening that receives the rotation-inhibiting structure of the shaft engaging member.

19. A golf club according to claim 11, wherein the rotation-inhibiting structure of the shaft engaging member has a square or rectangular cross section and the rotation-inhibiting structure of the club head engaging member includes a square or rectangular shaped opening that receives the rotation-inhibiting structure of the shaft engaging member.

20. A golf club according to claim 11, wherein the rotation-inhibiting structure of the shaft engaging member extends less than 25% of an overall axial length of the shaft engaging member.

21. A method of assembling a golf club, comprising:

engaging a shaft with a shaft engaging member having a first end and a second end, wherein the first end includes a cylindrical interior chamber for receiving the shaft, wherein an exterior surface of the first end includes an extending portion extending away from the cylindrical interior chamber, and wherein the second end includes a rotation-inhibiting structure;

engaging a golf club head with a club head engaging member having a first end and a second end, wherein the first end of the club head engaging member further includes a securing structure, and wherein the second end of the club head engaging member includes a rotation-inhibiting structure;

engaging the shaft engaging member with the club head engaging member by engaging the rotation-inhibiting structure of the shaft engaging member with the rotation-inhibiting structure of the club head engaging member; and releasably securing a securing member over the extending portion of the shaft engaging member with the securing structure of the club head engaging member, wherein the securing member, at least in part, releasably secures the shaft engaging member with the club head engaging member.

* * * * *